United States Patent [19]

Bullis et al.

[11] Patent Number: 4,499,755

[45] Date of Patent: Feb. 19, 1985

[54] EMITTED ION SURGE/STALL DETECTION

[75] Inventors: Robert H. Bullis, Avon, Conn.; Robert P. Couch, Palm Beach Gardens, Fla.

[73] Assignee: United Technologies Corporation, Hartford, Conn.

[21] Appl. No.: 454,122

[22] Filed: Dec. 28, 1982

[51] Int. Cl.[3] ..... G01M 15/00

[52] U.S. Cl. ..... 73/116; 60/39.03

[58] Field of Search ..... 73/116, 115; 324/459; 60/39.03

[56] References Cited

U.S. PATENT DOCUMENTS

| | | | |
|---|---|---|---|
| 3,426,322 | 2/1969 | Balo | 73/116 X |
| 4,103,544 | 8/1978 | Beckmann | 73/115 |
| 4,359,893 | 11/1982 | Kizler | 73/116 X |

*Primary Examiner*—John W. Caldwell, Sr.
*Assistant Examiner*—Ellwood G. Harding, Jr.
*Attorney, Agent, or Firm*—M. P. Williams; Gerald E. Linden

[57] ABSTRACT

Ions are emitted (14) into the gas stream (15) of a gas turbine engine at a point with respect to the gas stream (15), in comparison with the position of an ion-responsive electrostatic probe (24), so that there is a discernible, reliable difference in the ion impingement on the electrostatic probe (24) during normal gas flow (FIGS. 3 and 4) in contrast with that which occurs during the abnormal gas flow attendant a surge (FIG. 5) thereby to provide early and sustained detection of stall and/or surge conditions in the engine, even in the absence of flame from the combustor (17).

2 Claims, 5 Drawing Figures

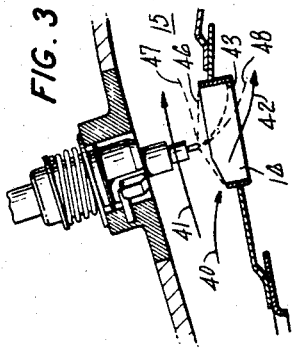
FIG. 3
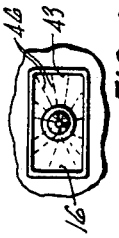
FIG. 4
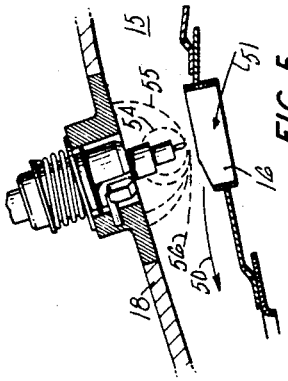
FIG. 5
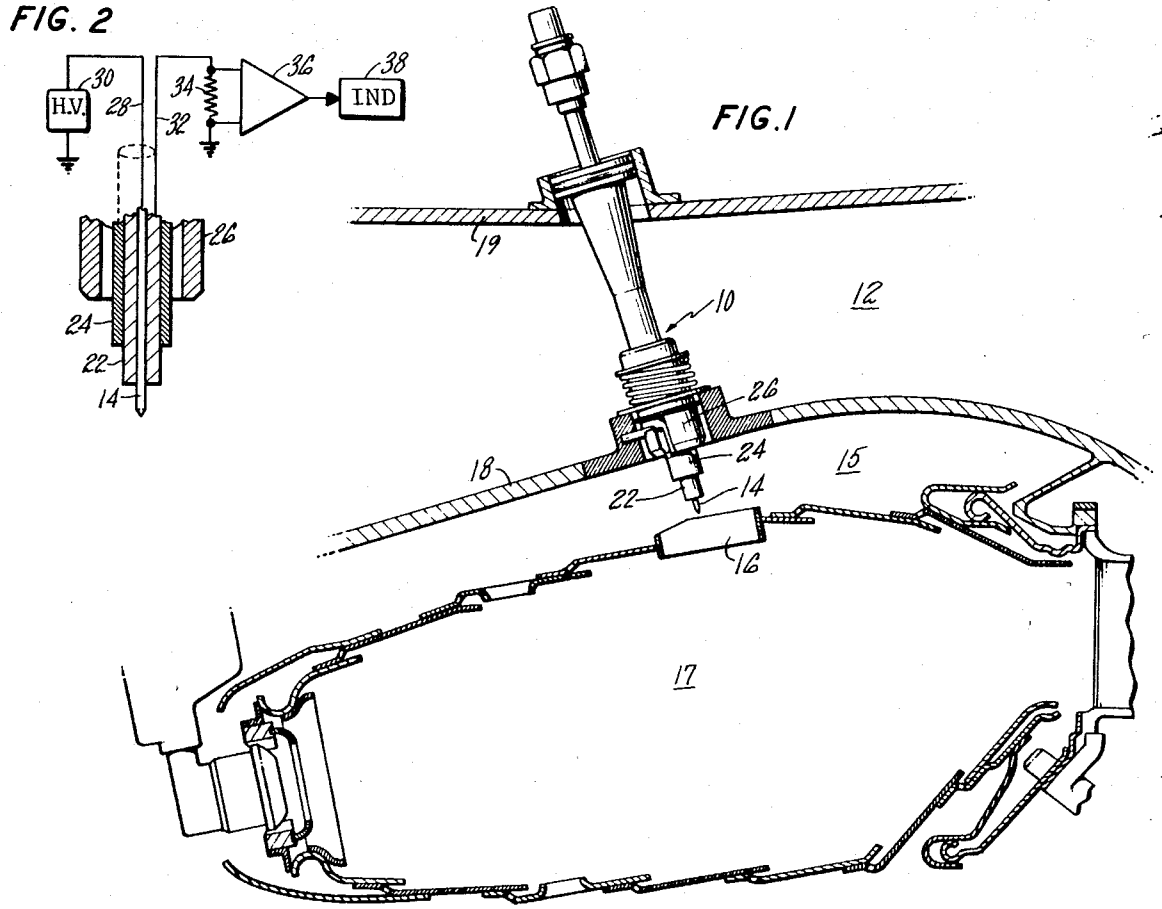
FIG. 1
FIG. 2

EMITTED ION SURGE/STALL DETECTION

TECHNICAL FIELD

This invention relates to detection of surge in a gas turbine engine by sensing a change in the response of an ion probe to ions emitted into the gas stream, as a consequence of changes in the gas stream which occur during engine surge.

BACKGROUND ART

As is known in the gas turbine art, compressor surge can occur as a consequence of stall conditions on a sufficient number of compressor blades. Blade stall is known to result from various conditions, including: severe acceleration (variously referred to as "jam" or "bodie"), during sideslip or skid (when in evasive action); as a consequence of turbulent air which upsets conditions at the engine air inlet; or from a violent afterburner light-off. These perturbations cause a sufficient change in the velocity of gas flow through the engine in contrast with the rotational velocity of the compressor blades, for a given compressor blade angle, so that the resultant angle of attack causes airfoil stall. When sufficient number of blades are stalled, a surge (a detectable, violet engine event) may occur. A mild surge may simply result in a momentary pressure drop and flow reversal of the gas stream which is self-recoverable. A more severe surge may result in multiple surge cycles which may be self-recoverable or may require control action to assist recovery. Under certain conditions, surges can result in rotating stall and airflow stagnation, in which the stall condition has so upset the compression process that sufficient energy for recovery is not available, without some external action being taken.

In the art, a variety of means are known for detecting surge/stall. For instance, devices which sense radial or upstream/downstream pressure ratios are disclosed in U.S. Pat. Nos. 3,858,625 and 4,103,544. Other devices sense stall as a function of compressor discharge pressure (or combustor inlet pressure) as in U.S. Pat. No. Re. 29,667. Still others utilize combinations of the fuel control schedule with temperature and/or pressure events in the engine, such as in U.S. Pat. Nos. 4,060,979, 4,060,980 and 4,117,688. A more currently common manner of detecting stall/surge is a ratio of temperature to rotor speed, as disclosed in U.S. Pat. Nos. 4,108,926 and 4,137,710. The early detection of stall is desirous in order to take corrective action to avoid multiple cycle surges or more severe surge effects, referred to as rotating stall stagnation. For instance, in U.S. Pat. No. Re. 29,667, stall sensed by compressor discharge pressure is utilized to open compressor bleeds, thereby unchoking the compressor and aiding it in recovery from the stall condition. Other corrective actions, such as reducing fuel flow and adjusting the angle of some of the compressor vanes (in an axial flow gas turbine), are also known.

In a commonly owned, copending U.S. patent application entitled "Electrostatic Gas Turbine Surge/Stall Detection", Ser. No. 454,121, filed contemporaneously herewith by St. Jacques et al, the early sensing of stall stagnation, and discriminating stall stagnation from surge is described as useful in providing corrective action for early recovery from stall stagnation.

In the aforementioned St. Jacques et al. application, rapid detection of any stall condition is achieved by utilizing a voltage-biased electrostatic probe at a dilution air (cooling or mixing air) inlet of the combustor (burner can); the probe normally is bathed simply in unburned air, but when reverse flow occurs, flame streams out of the combustor can past the electrostatic probe and provides significantly increased conductivity between the probe tip and the walls of the engine. This results in an electrical signal which is timed precisely to the reverse flow out of the combustor can.

One problem with the electrostatic surge/stall detector of the St. Jacques et al. application is that the probe is ineffective in the absence of flame. In some stall events, particularly where heavy de-rich (low fuel) is being utilized, no flame is sensed by the electrostatic probe. In other cases, it is possible for stall stagnation to occur to a sufficient degree to result in a flameout, whereby the flame-responsive surge/stall detector of the aforementioned application would provide an indication of recovery from stall stagnation correction, when such is not the case.

DISCLOSURE OF INVENTION

Objects of the invention include provision of a surge/stall detector which is not reliant on gas turbine engine combustor flame to provide an indication of stall or surge.

According to the invention, an electrostatic probe is disposed to be responsive to ions in the gas stream of an engine, ions are emitted into the gas stream of the engine, the point of entry of ions and the position of the electrostatic probe being such as to provide ion-induced signals during normal gas flow through the turbine which are distinctly different from ion-induced signals induced by flow variations during surge/stall.

The invention may be implemented in a variety of ways, one of which disclosed herein comprises use of a combined, coaxial probe which both emits and senses the presence of ions. The invention, not requiring the presence of flame, may be utilized alone or with a flame-responsive detector of the type diclosed in the aforementioned St. Jacques application, thereby quarding against false indications of recovery.

Other objects, features and advantages of the present invention will become more apparent in the light of the following detailed description of exemplary embodiments thereof, as illustrated in the accompanying drawings.

BRIEF DESCRIPTION OF DRAWINGS

FIG. 1 is a partial, sectional side elevation of a portion of a combustor (burner can) with an ion-emitting/responsive probe disposed in proximity therewith, in accordance with the present invention;

FIG. 2 is a partial, sectioned side elevation showing the construction of a coaxial probe for use in the embodiment of FIG. 1, and electrical connections thereto;

FIG. 3 is a partial, sectioned side elevation view of the probe in proximity with the burner can as in FIG. 1, illustrating gas flow and ion migration during normal engine operation;

FIG. 4 is a partial, pictorial plan view of the dilution air inlet of FIG. 3, further illustrating ion migration to the walls of the inlet;

FIG. 5 is a partial, sectioned side elevation view of the probe adjacent the dilution air inlet of the burner can, illustrating gas flow and ion migration during reverse flow conditions of a surge.

BEST MODE FOR CARRYING OUT THE INVENTION

Referring now to FIG. 1, an electrostatic probe 10 is disposed in the fan duct 12 of a turbofan engine with the ion-emitting tip 14 of the probe disposed in the air passage 15 surrounding the combustor 17, adjacent a dilution air inlet 16 thereof. The probe 10 may have a general configuration of a probe suitable for installation in a borescope access hole of an engine, including means to secure it to, and seal, the inner and outer fan duct walls 18, 19, as described in a commonly owned, copending U.S. application entitled "Gas Turbine Access Port Plug Electrostatic Probe", Ser. No. 454,113, filed contemporaneously herewith by Shattuck et al., as modified in the manner described with respect to FIG. 2 herein. In FIGS. 1 and 2, the probe 10 is seen to have a layer of insulation 22 surrounding the probe tip 14, and a hollow, conductive electrostatic probe member 24 disposed coaxially with the ion-emitting tip 14. The electrostatic probe 24 is insulated from a coaxially disposed frame portion 26, either by spatial isolation as shown in FIG. 2, or by suitable insulation, as desired. The ion-emitting tip 14 is connected by a suitable lead 28 to a high voltage source 30 which may be either A.C. or D.C.. The voltage is suitably chosen so as to provide a corona discharge from the tip 14 to the grounded engine walls 18. The electrostatic probe 24 (the ion-responsive probe portion) is connected by a suitable lead 32 through a resistor 34 to ground. An amplifier 36 responds to voltage developed across the resistor 34 as a result of ions flowing through the electrostatic probe 24 and lead 32 to ground, to provide a suitable indication, such as to an indicator 38, or to any other device, in dependence on how the present invention is utilized. Referring now to FIG. 3, during normal engine operation, air flows in the duct 15 as indicated by the arrows 40, 41 and some of it is diverted through the dilution air inlet 16 as indicated by the arrow 42. This causes the ions emitted by the probe tip 14 to migrate predominantly to the walls 43 of the inlet 16, as illustrated by the dotted lines 46 in FIGS. 3 and 4. Some of the ions may follow the main airflow indicated by the arrow 41, as illustrated by the dotted lines 47; and some of the ions may follow the airflow indicated by the arrow 42, as illustrated by the dotted lines 48. However, very few ions will flow or migrate to the ion-responsive electrostatic probe 24.

When a significant surge occurs, the burner inlet pressure becomes less than that in the burner itself, and flow in the duct 15 and the dilution air inlet 16 becomes reversed as shown by the arrows 50, 51 in FIG. 5. This results in flowing a significant number of ions in the direction of the ion-responsive electrostatic probe 24, as illustrated by the dotted lines 54; other ions will migrate to the inner wall 18 of the fan duct, as shown by dotted lines 55, and other ions may flow in the upstream direction of arrow 50, as indicated by the dotted lines 56. The flow and/or migration of ions 54 to the ion-responsive electrostatic probe 24 results in a sufficient signal across the resistor 34 so that the amplifier 36 will provide a suitable signal to the indicator 38 (or other utilizing apparatus) to serve the purposes for which the present invention may be used.

The coaxial arrangement shown herein and spacing with respect to the dilution air inlet 16 is not essential to the practice of the present invention: it sufficies that the ions be emitted at a point with respect to the gas stream, in comparison with the position of the ion-responsive electrostatic probe 24, so that there is a discernible, reliable difference in the signal resulting from ion impingement on the electrostatic probe 24 during normal gas flow (FIGS. 3 and 4) in contrast with that which occurs during the abnormal gas flow attendant a surge (FIG. 5).

The ion source could be radioactive source or a photon light source which produces ions off a surface.

The signal provided by the present invention may be used in the manner described in the aforementioned St. Jacques et al application, or in other manners to suit any related design requirement.

Thus although the invention has been shown and described with respect to exemplary embodiments thereof, it should be understood by those skilled in the art that the foregoing and various other changes, omissions and additions may be made therein and thereto, without departing from the spirit and the scope of the invention.

We claim:

1. Apparatus for detecting surge and/or stall in a gas turbine engine comprising:

means for emitting ions into the gas stream of the engine; and electrostatic probe means, for providing a signal indicative of impingement of the ions on the electrostatic probe means, said probe means disposed at a point in the gas stream of the engine selected such that:

the ions migrate predominantly away from the electrostatic probe means, resulting in a signal indicative of few ions migrating to and impinging on the electrostatic probe means when the gas stream is flowing in a direction indicative of normal engine operation; and a significant number of ions flow in the direction of the electrostatic probe means, resulting in a signal indicative of a significant number of ions flowing in the direction of and impinging on the electrostatic probe means when there is a reverse gas stream flow in the engine indicative of a significant surge in the engine.

2. Apparatus for detecting surge and/or stall in a gas turbine engine, said engine having an air passage surrounding a combustor and an air inlet disposed for communication of air from the air passage to the combustor, comprising:

means for emitting ions into the air passage; and electrostatic probe means, for providing a signal indicative of ion impingement on the electrostatic probe means, said probe means disposed adjacent the air inlet so that:

the ions migrate predominantly away from the probe means and towards the air inlet in response to the flow of air during normal engine operation, resulting in a signal indicative of relatively few ions migrating to and impinging on the probe means; and a significant number of ions flow in the direction of the probe means in response to a reverse air flow during a significant surge in the engine, resulting in a signal indicative of the significant number of ions impinging the probe means.

* * * * *

UNITED STATES PATENT AND TRADEMARK OFFICE

CERTIFICATE OF CORRECTION

PATENT NO. : 4,499,755

DATED : February 19, 1985

INVENTOR(S) : Robert H. Bullis et al

It is certified that error appears in the above-identified patent and that said Letters Patent is hereby corrected as shown below:

Column 1, line 26: "violet" should read "violent"

Column 2, line 40 "diclosed" should read "disclosed"

Column 2, line 41 "quarding" should read "guarding"

Signed and Sealed this

*Seventeenth* Day of *December 1985*

[SEAL]

*Attest:*

DONALD J. QUIGG

*Attesting Officer* *Commissioner of Patents and Trademarks*